US008913466B2

(12) United States Patent
Fujisawa

(10) Patent No.: US 8,913,466 B2
(45) **Date of Patent: *Dec. 16, 2014**

(54) ELECTRONIC TIMEPIECE WITH INTERNAL ANTENNA

(71) Applicant: Seiko Epson Corporation, Tokyo (JP)

(72) Inventor: Teruhiko Fujisawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/037,671

(22) Filed: Sep. 26, 2013

(65) Prior Publication Data

US 2014/0029388 A1 Jan. 30, 2014

Related U.S. Application Data

(63) Continuation of application No. 13/293,183, filed on Nov. 20, 2011, now Pat. No. 8,570,838.

(30) Foreign Application Priority Data

Nov. 12, 2010 (JP) ..... 2010-253429
Jun. 29, 2011 (JP) ..... 2011-144253

(51) Int. Cl.

| | |
|---|---|
| ***G04R 60/10*** | (2013.01) |
| ***H01Q 1/27*** | (2006.01) |
| ***G04C 10/02*** | (2006.01) |
| ***G04R 60/12*** | (2013.01) |
| ***H01Q 13/10*** | (2006.01) |
| ***G04R 60/06*** | (2013.01) |

(52) U.S. Cl.

CPC ..... *G04R 60/10* (2013.01); *G04C 10/02* (2013.01); *G04R 60/12* (2013.01); *H01Q 1/273* (2013.01); *H01Q 13/10* (2013.01); *G04R 60/06* (2013.01)

USPC ..... 368/47; 368/88; 343/718; 343/767

(58) Field of Classification Search

CPC ..... G04R 60/06; G04R 60/10; G04R 60/12; H01Q 1/273; H01Q 13/10

USPC ..... 368/10, 47, 88, 281; 343/702, 718, 343/700 MS, 767

See application file for complete search history.

(56) References Cited

U.S. PATENT DOCUMENTS

| | | | | |
|---|---|---|---|---|
| 5,642,120 | A | 6/1997 | Fujisawa | |
| 5,757,326 | A | 5/1998 | Koyama et al. | |
| 5,940,041 | A * | 8/1999 | Koyama et al. | 343/702 |
| 6,130,647 | A | 10/2000 | Zurcher et al. | |
| 6,724,690 | B1 | 4/2004 | Endo et al. | |
| 7,215,600 | B1 | 5/2007 | DeRosa | |
| 2005/0054321 | A1 | 3/2005 | Casagrande et al. | |
| 2005/0219955 | A1 | 10/2005 | Xu et al. | |
| 2009/0207083 | A1 * | 8/2009 | Miyazaki et al. | 343/702 |

FOREIGN PATENT DOCUMENTS

| | | |
|---|---|---|
| JP | 07-193416 | 7/1995 |
| JP | 2000-059241 | 2/2000 |

* cited by examiner

*Primary Examiner* — Vit W Miska

(57) ABSTRACT

An electronic timepiece with internal antenna maintains sufficiently high reception performance of circularly polarized waves even when having a metal external case. A drive unit of the timepiece counts a time inside the external case. An antenna has a tubular-shaped side part, a bottom part that covers one of two openings of the side part, and a top part that contacts an inside surface of the side part inside the external case. The bottom part is a back cover of the external case, and the top part has a slot part.

12 Claims, 13 Drawing Sheets

ELECTRONIC TIMEPIECE WITH INTERNAL ANTENNA

CROSS-REFERENCE TO RELATED APPLICATIONS

This application is a continuation of, and claims priority under 35 U.S.C. §120 on, application Ser. No. 13/293,183 filed Nov. 10, 2011, which claims priority under 35 U.S.C. §119 on Japanese patent application nos. 2010-253429 and 2011-144253, filed Nov. 12, 2010 and Jun. 29, 2011 respectively. Each such related application is incorporated by reference in its entirety.

BACKGROUND

1. Technical Field

The present invention relates to an electronic timepiece with an internal antenna.

2. Related Art

Japanese Unexamined Patent Appl. Pub. JP-A-2000-59241 teaches an electronic timepiece with internal antenna that has a ring antenna (dipole antenna) that uses a metal case member as a ground plane. Because the ground plane operates as a reflector in this ring antenna, the ground plane must be sufficiently separated from the antenna electrode on a dielectric. Japanese Unexamined Patent Appl. Pub. JP-A-H07-193416 teaches an electronic timepiece with an internal antenna that houses a slot antenna inside the external case. A slot antenna is an antenna with a slot (slit) in a metal plate.

It may also be desirable to use metal case members for the external case of a wristwatch. While the electronic timepiece with an internal antenna described in JP-A-2000-59241 has a metal case, balancing maintaining reception performance with a small wristwatch size is difficult because the antenna electrode and the ground plane (case member) must be sufficiently separated in order to ensure sufficiently high reception performance. Using a slot antenna is preferable in order to reduce the size while also maintaining reception performance.

The electronic timepiece with an internal antenna taught in JP-A-H07-193416 uses a slot antenna, but cannot receive circularly polarized waves, one example of which are satellite signals from GPS (Global Positioning System) satellites. JP-A-H07-193416 also does not describe a configuration suitable to using an external case made of metal.

SUMMARY

The present invention is directed to solving the foregoing problem, and an object of the invention is to provide a small electronic timepiece with an internal antenna that can maintain sufficiently high reception performance of circularly polarized waves even when a metal case is used.

A first aspect of the invention is an electronic timepiece with internal antenna comprising an external case; a drive unit within the external case that keeps time; an antenna that has a tube-shaped side part, a bottom part that covers one of two openings on the side part, and a top part that is in contact with an inside circumference of the side part within the external case. The bottom part is a back cover of the external case, and the top part has a slot section.

Preferably, a slot extending along the inside circumference of the side part is formed on the slot section.

A dielectric material in contact with the top part may be provided within the side part.

The dielectric material may overlap a portion or all of the slot.

The drive unit can be placed between the bottom and top parts.

With these arrangements, the internal antenna functions as a slot antenna. Because a slot antenna is an antenna with a slot formed in a metal plate, reception performance does not drop even if a metal external case is used. Furthermore, because the slot extends circumferentially to the side part, satellite signals (right-handed polarized waves) from GPS satellites and other circularly polarized waves can be received. Furthermore, because part or all of the slot is covered by a dielectric, the antenna diameter can be shortened by the wavelength shortening effect. Furthermore, because the drive mechanism is housed inside the antenna, antenna size can be increased while also saving space.

The external case may have a metal section formed by metal.

The metal section may double as part or all of the side part.

In this embodiment, the metal section of the external case can be part of the antenna. With this configuration the side part does not need to be provided separately from the external case. This contributes to a smaller size and lighter weight.

As a result, the invention can provide a small electronic timepiece with internal antenna that can maintain sufficiently high reception performance of circularly polarized waves even if a metal external case is used. Yet further, the bottom part does not need to be provided separately from the back cover, thus contributing to reducing size and weight.

In another aspect of the invention, the electronic timepiece further includes a cover glass; hands; and a dial plate positioned between the hands and the top part. The hands are driven by a drive mechanism of the drive unit. Also, the slot is positioned between the dial plate and the side part when viewed from a direction perpendicular to the cover glass.

In other aspects, the top part has a center section surrounded by the slot section, and the center section has a hole through the axis about which the hands rotate passes.

Examples of "hands" include an hour hand, minute hand, and/or second hand.

As a result, a configuration typical of a common analog timepiece in which the center shaft passes through the center part of the dial can be used. Note that because the center of the top part does not particularly contribute to reception performance, reception performance is not particularly degraded by opening a hole in the center of the top part.

Further preferably, an electronic timepiece with internal antenna according to another aspect of the invention also has an image display part that displays an image and is disposed between the top part and the bottom part. The top part has a center section surrounded by the slot section, and the center section has a hole for visually verifying the image.

This aspect of the invention enables a hybrid timepiece having both an analog display and a digital display. Note that the center of the top part does not particularly contribute to reception performance as described above.

According to another aspect of the invention, the electronic timepiece includes a cover glass; and a photoelectric conversion panel that converts light energy into electrical energy. The photoelectric conversion panel is placed between the cover glass and the top part and is housed inside the slot section.

So positioning the photoelectric conversion plate maintains reception performance. Note that the part of the top part that is covered by the photovoltaic conversion plate does not particularly contribute to reception performance as described above.

In an electronic timepiece with internal antenna according to another aspect of the invention, the shape of the slot is a C-shape; and the antenna has a feeding point at a prescribed position with respect to a tip of the slot. The reception performance of circularly polarized waves is extremely high with this configuration.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the size and scale of parts shown in the figures differ from the actual for convenience. Furthermore, because the following examples are specific preferred embodiments of the invention and describe technically desirable limitations, the scope of the invention is not limited thereby unless such limitation is specifically stated below.

Embodiment 1

Figure 1:
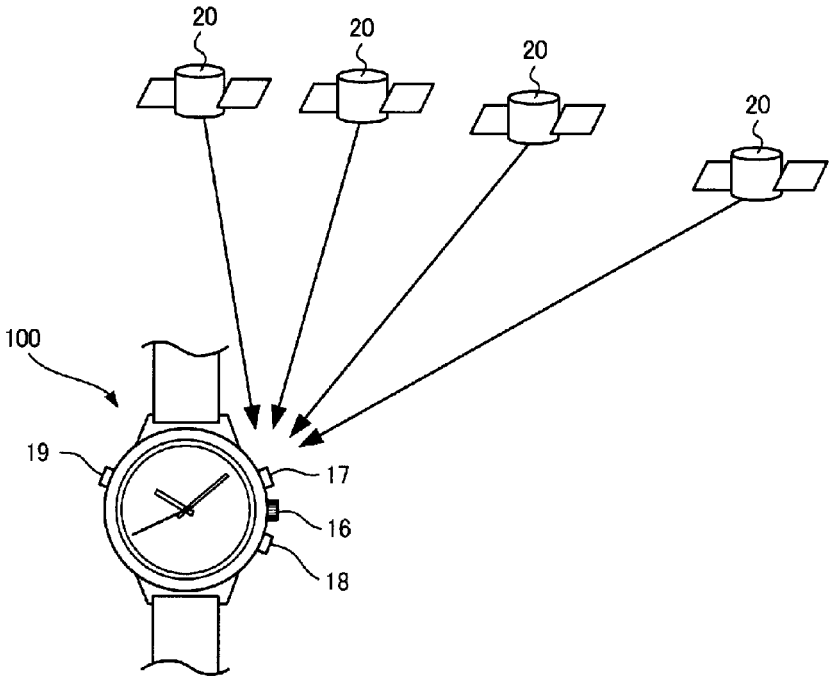
FIG. 1 shows the general configuration of a GPS system including an electronic time piece with internal antenna 100 (electronic timepiece 100) according to a first embodiment of the invention.

FIG. 1 shows the general configuration of a GPS system including an electronic timepiece with internal antenna 100 (electronic timepiece 100) according to a first embodiment of the invention. This electronic timepiece 100 is a wristwatch that receives signals (radio signals) from GPS satellites 20 and adjusts the internal time, and displays the time on the surface (side) (referred to below as the "face") on the opposite side as the surface (referred to below as the "back") that contacts the wrist.

A GPS satellite 20 is a positioning information satellite that orbits the Earth on a fixed orbit, and transmits navigation messages superimposed on a 1.57542 GHz RF signal (L1 signal). The 1.57542 GHz signal carrying a superimposed navigation message is referred to herein as simply a "satellite signal." These satellite signals are right-handed circularly polarized waves.

There are currently approximately 31 GPS satellites 20 in orbit (only 4 of the 31 satellites are shown in FIG. 1). To determine from which GPS satellite 20 a satellite signal was sent, each GPS satellite 20 a unique 1023 chip (1 ms period) pattern called a C/A code (Coarse/Acquisition code) on the satellite signal. Each chip in the C/A code is either +1 or −1, and looks like a random pattern. The C/A code superimposed on the satellite signal can therefore be detected by determining the correlation between the satellite signal and each C/A code pattern.

Each GPS satellite 20 carries an atomic clock, and the highly precise time information ("GPS time information" below) kept by the atomic clock is superimposed on each satellite signal. The slight time difference of the atomic clock onboard each GPS satellite 20 is measured by the ground control segment, and a time correction parameter for correcting this time difference is also included in the satellite signal. The electronic timepiece 100 receives a satellite signal transmitted from one GPS satellite 20, and corrects the internal time to the correct current time based on the GPS time information and time correction parameter contained in the received satellite signals.

Orbit information describing the position of the GPS satellite 20 on its orbit is also included in the satellite signal. The electronic timepiece 100 can perform a positioning calculation using the GPS time information and orbit information. This positioning calculation assumes that there is a certain amount of error in the internal time of the electronic timepiece 100. More specifically, in addition to the x, y, z parameters for determining the three-dimensional position of the electronic timepiece 100, this time difference is also an unknown. Therefore, the electronic timepiece 100 generally receives satellite signals transmitted from four or more GPS satellites, and calculates the current position using the GPS time information and orbit information contained in the received signals.

Figure 2:
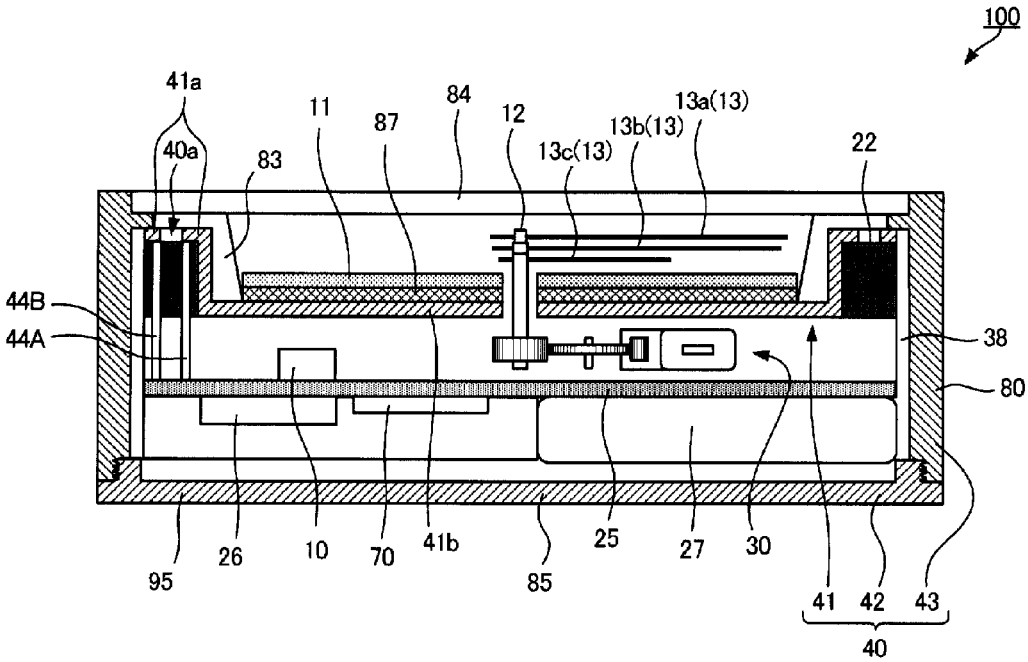
FIG. 2 is a partial section view of the electronic timepiece 100.
Figure 3:
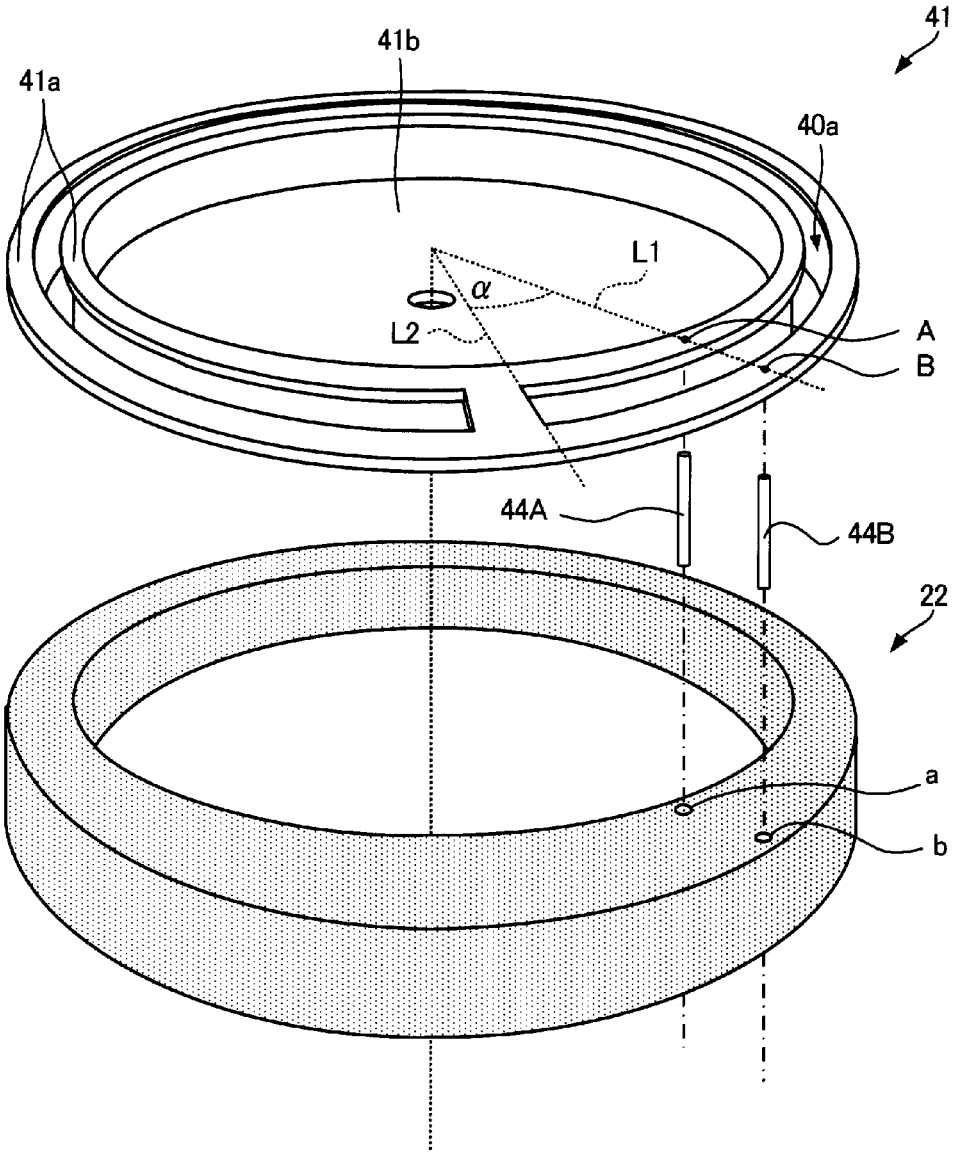
FIG. 3 is an exploded perspective view of part of the electronic timepiece 100.

FIG. 2 is a partial section view of the electronic timepiece 100, and FIG. 3 is an exploded perspective view of part of the electronic timepiece 100.

As shown in FIG. 2, the electronic timepiece 100 has a cylindrical external case (metal part) 80 made of stainless steel (SUS), titanium, or other metal. An annular dial ring 83 made of plastic is attached to the inside circumference of the case 80 on the face side. Of the two openings in the case 80, the opening on the face side is closed by a crystal 84, and the opening on the back side is covered by a back cover 85 made of metal. The metal back cover 85 and the metal case 80 screw together, and are used as part of the slot antenna.

The electronic timepiece 100 also has a lithium ion or other type of storage battery 27 inside the case 80. The storage battery 27 is charged by power generated by a solar panel 87 described below, that is, is charged by solar power.

The electronic timepiece 100 also has a light-transparent dial 11, a center shaft 12 that passes through the dial 11, plural hands 13 (including a second hand 13*a*, minute hand 13*b*, and hour hand 13*c*) that indicate the current time and rotate on the center shaft 12, and a drive mechanism 30 that causes the center shaft 12 to turn and drives the plural hands 13 disposed inside the case 80. The center shaft 12 extends between the face and back on the center axis of the case 80.

The dial 11 is a disc-shaped and is made of plastic or other optically transparent material disposed on the inside of the dial ring 83 with the hands 13 between the dial 11 and the crystal 84. A hole through which the center shaft 12 passes is formed in the center of the dial 11.

The drive mechanism 30 is disposed to the main plate 38, includes a drive train including a stepper motor and wheel train, and drives the plural hands 13 as a result of the stepper motor causing the hands to turn through the wheel train. More specifically, the hour hand 13*c* turns one revolution in 12 hours, the minute hand 13*b* turns one revolution in 60 minutes, and the secondhand 13*a* turns one revolution in 60 seconds. The main plate 38 to which the drive mechanism 30 is affixed is disposed with the dial 11 between the main plate 38 and the hands 13.

The electronic timepiece 100 also has an antenna 40 that is shaped like a hollow cylinder of which the top is moved toward the bottom side. The antenna 40 has a cylindrically-shaped side part 43 made of metal. The center axis of the side part 43 is aligned with the center shaft 12. In this embodiment of the invention the case 80 functions as the side part 43. The antenna 40 also has a metal bottom part 42 that closes the back cover side opening of the two openings of the side part 43, and a metal antenna electrode (top surface part) 41 that extends transversely to the center axis of the side part 43 inside the case 80 and contacts the inside circumference of the side part 43. In this embodiment of the invention the back cover 85 functions as the bottom part 42 of the antenna 40.

The antenna electrode 41 is disposed between the bottom part 42 and dial 11, and is a stainless steel plate disposed with the drive mechanism 30 disposed between it and the bottom part 42. More specifically, the drive mechanism 30 is housed inside the antenna 40. The antenna electrode 41 also includes a round center part 41*b* in which a hole through which the center shaft 12 passes is formed, and a slot part 41*a* that extends circumferentially to the side part 43 on the face side of the center part 41*b* and encircles the center part 41*b* in the direction in which the antenna electrode 41 extends. A C-shaped slot 40*a* extending circumferentially to the side part 43 is formed in the slot part 41*a*. More specifically, the antenna 40 functions like a circular slot antenna with the complementary structure of a C-shaped ring antenna. Note that the depth of the slot 40*a* is aligned with the direction between the face and back cover.

The electronic timepiece 100 also has an O-shaped dielectric 22 that extends circumferentially to the side part 43 and contacts the antenna electrode 41 in the face-back cover direction inside the case 80. The dielectric 22 is a ceramic insulator or other type of dielectric, but the dielectric 22 could be made by insert molding plastic mixed with a dielectric. Alternatively, the antenna electrode 41 could be a two-part construction of a slot part 41*a* and center part 41*b*, and the dielectric 22 and slot part 41*a* could be formed by insert molding. Through-holes a and b are also formed in the dielectric 22 in the center axis direction of the side part 43. A conductive pin 44A described below passes through through-hole a, and a conductive pin 44B described below passes through through-hole b.

The dielectric 22 covers all of slot 40*a* in the face-back cover direction. Because the slot part 41*a* is on the face side of the center part 41*b* as described above, a space extending circumferentially to the side part 43 is retained between an extension of the center part 41*b* and the slot part 41*a*. The dielectric 22 is disposed in this space. Note that the dielectric 22 and the slot part 41*a* are covered by the dial ring 83 when seen from the face side.

Power supply to the antenna 40 is balanced on both sides of the slot 40*a*. More specifically, the slot part 41*a* of the antenna electrode 41 has a positive supply node A on the inside of the slot 40*a*, and a negative supply node B on the outside of the slot 40*a*. Power supply nodes A and B are opposed radially to the side part 43 with the slot 40*a* therebetween, and are closer to one end of the slot 40*a* than the other.

The angle ($\alpha$) between a first line L1 and a second line L2 is 10°<=90° where first line L1 passes through power supply nodes A and B and extends radially to the side part 43, and second line L2 passes through one end of first line L1, extends radially to the side part 43, and intersects first line L1. In other words, power supply nodes A and B are disposed within a range of 10°<=90° from the closer of the two ends of the slot 40*a*.

The antenna 40 therefore operates as a good circularly polarized wave transmission and reception antenna, and outputs received signals as balanced reception signals. Note that if $\alpha$ is outside the range 10°<=90°, the antenna 40 still operates normally for linear polarized waves. In addition, to improve reception performance, the slot 40*a* is preferably disposed on the face side of the timepiece directly below the crystal. Because the slot 40*a* is disposed on the face side of the dial 11 with only the dial ring 83 between the slot 40*a* and the crystal 84 in this embodiment of the invention, sufficiently high reception performance is achieved. In addition, while there is a hole in the center part 41*b* of the antenna electrode 41 in this embodiment of the invention, there is no appreciable drop in reception performance because the center part of a circular slot antenna does not contribute appreciably to reception performance.

In principle, the slot length (the length in which the slot extends) in a circular slot antenna must be greater than approximately one wavelength of the received waves. When the received circularly polarized waves are satellite signals, the wavelength is approximately 19 cm. However, achieving a slot length of 19 cm or more in a wristwatch is difficult considering the severe size limitations. The slot length is therefore shortened in this embodiment of the invention by the wavelength shortening effect of the dielectric. More specifically, by covering all of the slot 40*a* with a dielectric 22 as described above, the slot length is reduced to approximately 11 cm. A dielectric with a relative constant of approximately 16 (such as a dielectric ceramic) is suitable as the dielectric 22. Such dielectrics are easily obtained.

The electronic timepiece 100 also has a solar panel 87 for photovoltaic generation inside the case 80. The solar panel 87 is a disc with a plurality of solar cells (photovoltaic devices) that convert light energy to electrical energy (power) connected in series, is disposed between the dial 11 and the drive mechanism 30, and extends transversely to the center shaft 12. The solar panel 87 is disposed in this extension direction inside the dial ring 83. A hole through which the center shaft 12 passes is formed in the center part of the solar panel 87.

Note that when seen from the face side the antenna electrode 41 is covered by the dial ring 83 and solar panel 87, and the solar panel 87 is covered by the dial 11. Because the solar panel 87 has electrodes, signal reception is difficult by the part of the antenna electrode 41 that is covered by the solar panel 87. However, the part that is covered by the solar panel 87 is part of the center part 41*b* of the antenna electrode 41, and this part does not contribute much to reception performance as described above. In addition, the center shaft 12 protrudes from the top of the main plate 38, and the antenna electrode 41 passes through holes formed in the center parts of the solar panel 87 and the dial 11.

The electronic timepiece 100 also has conductive pins 44A and 44B, a circuit board 25, a balun 10 mounted on the circuit board 25, a GPS receiver (wireless reception unit) 26, and a control unit 70 inside of the case 80. The balun 10 is a balanced-unbalanced conversion device, and converts balanced signals from the antenna 40, which operates with a balanced power supply, to unbalanced signals that can be handled by the GPS reception unit 26.

Conductive pin 44A is metal, passes through the main plate 38 and dielectric 22, and connects to the positive power supply node A and the circuit board 25. Conductive pin 44B is metal, passes through the main plate 38 and dielectric 22, and connects to the negative power supply node B and the circuit board 25. In other words, this electronic timepiece 100 supplies balanced power through conductive pins 44A and 44B. The GPS reception unit 26 receives radio signals through the antenna 40.

By manipulating the crown 16 and buttons 17, 18, and 19 shown in FIG. 1, the electronic timepiece 100 can be set to a mode (time information acquisition mode) that receives satellite signals from at least one GPS satellite 20 and adjusts the internal time information, and a mode (positioning information acquisition mode) that receives satellite signals from a plurality of GPS satellites 20, performs a positioning calculation, and adjusts the time difference of the internal time information. The electronic timepiece 100 can also regularly (automatically) execute the time information acquisition mode and the positioning information acquisition mode.

Figure 4:
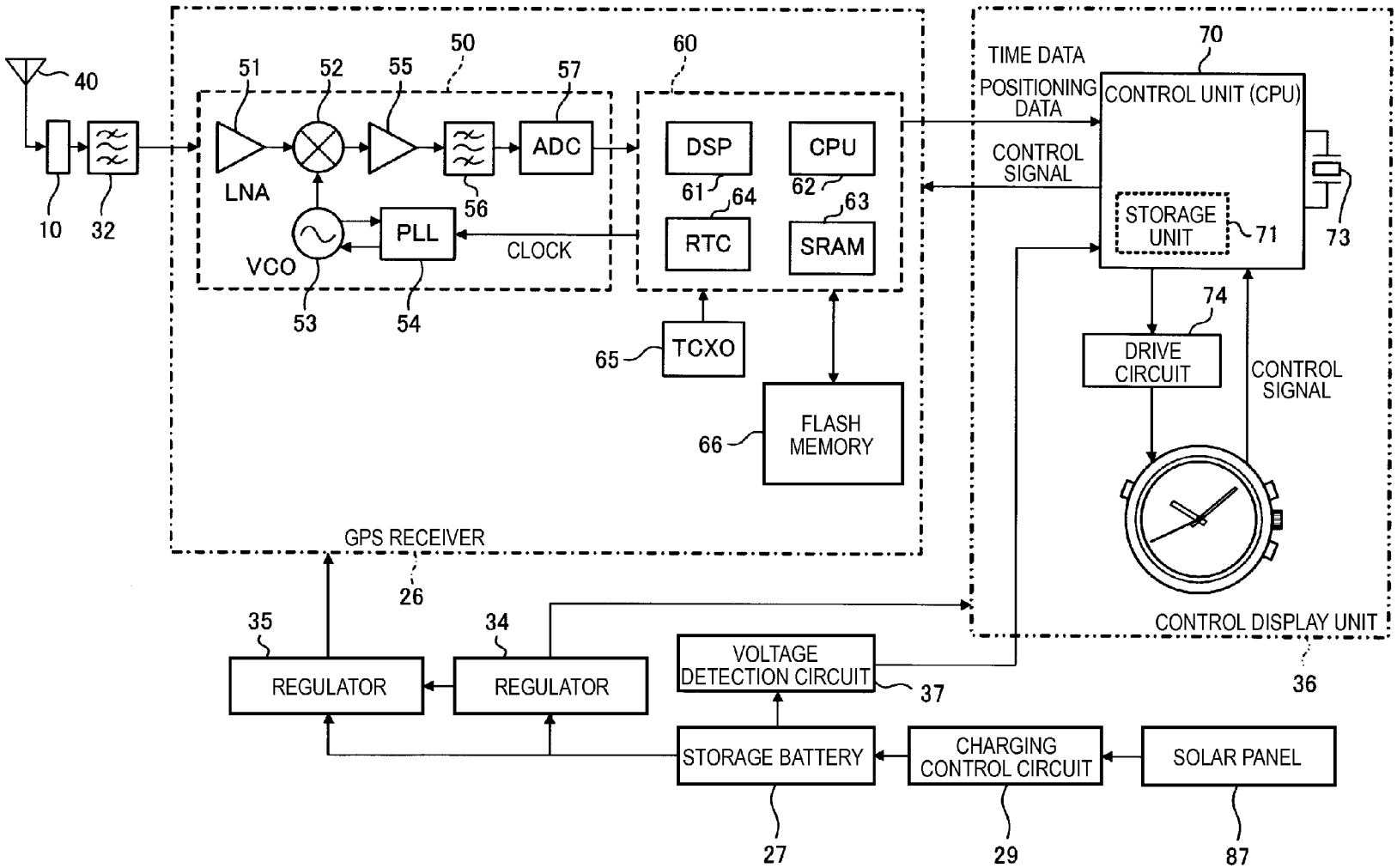
FIG. 4 is a block diagram showing the circuit configuration of the electronic timepiece 100.

FIG. 4 is a block diagram showing the circuit configuration of the electronic timepiece 100.

The electronic timepiece 100 is configured with a GPS reception unit 26 and a control display unit 36. The GPS reception unit 26 executes processes including receiving satellite signals, capturing GPS satellites 20, generating positioning information, and generating time adjustment information. The control display unit 36 executes processes including holding the internal time information, and correcting the internal time information.

The solar panel 87 charges the storage battery 27 with power through the charging control circuit 29. The electronic timepiece 100 also includes a regulators 34 and 35, and the storage battery 27 supplies drive power through regulator 34 to the control display unit 36, and through regulator 35 to the GPS reception unit 26. The electronic timepiece 100 also has a voltage detection circuit 37 that detects the storage battery 27 voltage.

Alternatively, the regulator 35 could be split into a regulator 35-1 (not shown in the figure) that supplies drive power to the RF unit 50 (described below), and a regulator 35-2 (not shown in the figure) that supplies drive power to the baseband unit 60 (described below). In this case, regulator 35-1 could be disposed in the RF unit 50.

The electronic timepiece 100 also includes the antenna 40, balun 10, and a SAW (surface acoustic wave) filter 32. As described in FIG. 2, the antenna 40 is a slot antenna that receives satellite signals from a plurality of GPS satellites 20. However, because the antenna 40 also receives some extraneous signals other than satellite signals, the SAW filter 32 executes a process that extracts the satellite signals from the signals received by the antenna 40. More specifically, the SAW filter 32 is configured as a bandpass filter that passes signals in the 1.5 GHz waveband.

The GPS reception unit 26 includes the RF (radio frequency) unit 50 and baseband unit 60. As described below, the GPS reception unit 26 executes a process that acquires satellite information including orbit information and GPS time information contained in the navigation messages from the satellite signals in the 1.5 GHz band extracted by the SAW filter 32.

The RF unit 50 is composed of a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

Satellite signals extracted by the SAW filter 32 are amplified by the LNA 51. The satellite signals amplified by the LNA 51 are mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the clock signal output from the VCO 53 to the reference clock signal. As a result, the VCO 53 can output a stable clock signal with the frequency precision of the reference clock signal. Note that several megahertz, for example, can be selected as the intermediate frequency.

The mixed signal output from the mixer 52 is amplified by the IF amplifier 55. This mixing by the mixer 52 results in both an IF signal and a high frequency signal of several GHz. As a result, the IF amplifier 55 amplifies both the IF signal and the high frequency signal of several GHz. The IF filter 56 passes the IF signal and removes the high frequency signal of several GHz (more accurately, attenuates the signal to a specific level or less). The IF signal passed by the IF filter 56 is converted to a digital signal by the A/D converter 57.

The baseband unit 60 includes a DSP (Digital Signal Processor) 61, CPU (Central Processing Unit) 62, SRAM (Static Random Access Memory) 63, RTC (real-time clock) 64. A TCXO (Temperature Compensated Crystal Oscillator) 65 and flash memory 66 are also connected to the baseband unit 60.

The TCXO 65 generates a reference clock signal of a substantially constant frequency regardless of temperature. Time difference information, for example, is stored in flash memory 66. The time difference information is information with a defined time difference (such as correction to UTC related to coordinates (such as latitude and longitude)).

The baseband unit 60 executes a process that demodulates the baseband signal from the digital signal (IF signal) converted by the A/D converter 57 of the RF unit 50 when set to the time information acquisition mode or the positioning information acquisition mode.

In addition, when set to the time information acquisition mode or the positioning information acquisition mode, the baseband unit 60 generates a local code of the same pattern as each C/A code in the satellite search step described below, and executes a process that correlates the local codes to the C/A code contained in the baseband signal. The baseband unit 60 adjusts the timing when the local code is generated so that the correlation to each local code peaks, and when the correlation equals or exceeds a threshold value, determines that the local code synchronized with the GPS satellite 20 (that is, that a GPS satellite 20 was captured). Note that the GPS system uses a CDMA (Code Division Multiple Access) method whereby all GPS satellites 20 transmit satellite signals on the same frequency using different C/A codes. Therefore, by identifying the C/A code contained in the received satellite signal, GPS satellites 20 from which satellite signals can be captured can be found.

When in the time information acquisition mode or the positioning information acquisition mode, the baseband unit 60 also executes a process that mixes the baseband signal with the local code of the same pattern as the C/A code of the GPS satellite 20 in order to acquire the satellite information for the captured GPS satellite 20. The navigation message containing the satellite information of the captured GPS satellite 20 is demodulated in the mixed signal. The baseband unit 60 then executes a process to detect the TLM word (preamble data) of each subframe in the navigation message, and acquire (such as store in 63) satellite information such as the orbit information and GPS time information contained in each subframe. The GPS time information as used here is the week number (WN) and Z count, but only the Z count data could be acquired if the week number was previously acquired.

The baseband unit 60 then generates the time adjustment information required to correct the internal time information based on the satellite information.

In the time information acquisition mode, the baseband unit 60 more specifically calculates the time based on the GPS time information, and outputs time adjustment information. The time adjustment information in the time information acquisition mode could be, for example, the GPS time information itself, or information about the time difference between the GPS time information and the internal time information.

However, in the positioning information acquisition mode, the baseband unit 60 more specifically calculates the position based on the GPS time information and orbit information, and acquires position information (more specifically the latitude and longitude of the place where the electronic timepiece 100 was located when the signals were received). The baseband unit 60 also references the time difference information stored in flash memory 66, and acquires time difference data related to the coordinates (such as the latitude and longitude) of the electronic timepiece 100 identified by the position information. The baseband unit 60 thus generates satellite time data (GPS time) and time difference data as the time adjustment information. The time adjustment information in the positioning information acquisition mode may be the GPS time information and time difference data as described above, but instead of the GPS time may alternatively be the time difference between GPS time and the internal time.

Note that the baseband unit 60 may generate the time adjustment information based on satellite information from one GPS satellite 20, but could generate the time adjustment information based on satellite information from plural GPS satellites 20.

Operation of the baseband unit 60 is synchronized to the reference clock signal output by the TCXO 65. The RTC 64 generates timing signals for processing the satellite signals. This RTC 64 counts up at the reference clock signal output from the TCXO 65.

The control display unit 36 includes a control unit 70, drive circuit 74, and crystal oscillator 73.

The control unit 70 has a storage unit 71 and RTC (real-time clock) 72, and controls various operations. The control unit 70 can be rendered by a CPU, for example.

The control unit 70 sends control signals to the GPS reception unit 26, and controls the reception operation of the GPS reception unit 26. Based on output from the voltage detection circuit 37, the control unit 70 also controls operation of regulator 34 and regulator 35. The control unit 70 also controls driving all of the hands through the drive circuit 74.

Internal time information is stored in the storage unit 71. The internal time information is information about the time kept internally by the electronic timepiece 100, and is updated at a reference clock signal generated by the crystal oscillator 73. Updating the internal time information and moving the hands can therefore continue even when power supply to the GPS reception unit 26 stops.

When the time information acquisition mode is set, the control unit 70 controls operation of the GPS reception unit 26, and corrects and stores the internal time information in the storage unit 71 based on the GPS time information. More specifically, the internal time information is adjusted to UTC (Coordinated Universal Time), which is obtained by adding the UTC offset to the acquired GPS time. When set to the positioning information acquisition mode, the control unit controls operation of the GPS reception unit 26, and based on the satellite time information (GPS time) and time difference data, adjusts and stores the internal time information in the storage unit 71.

Figure 5:
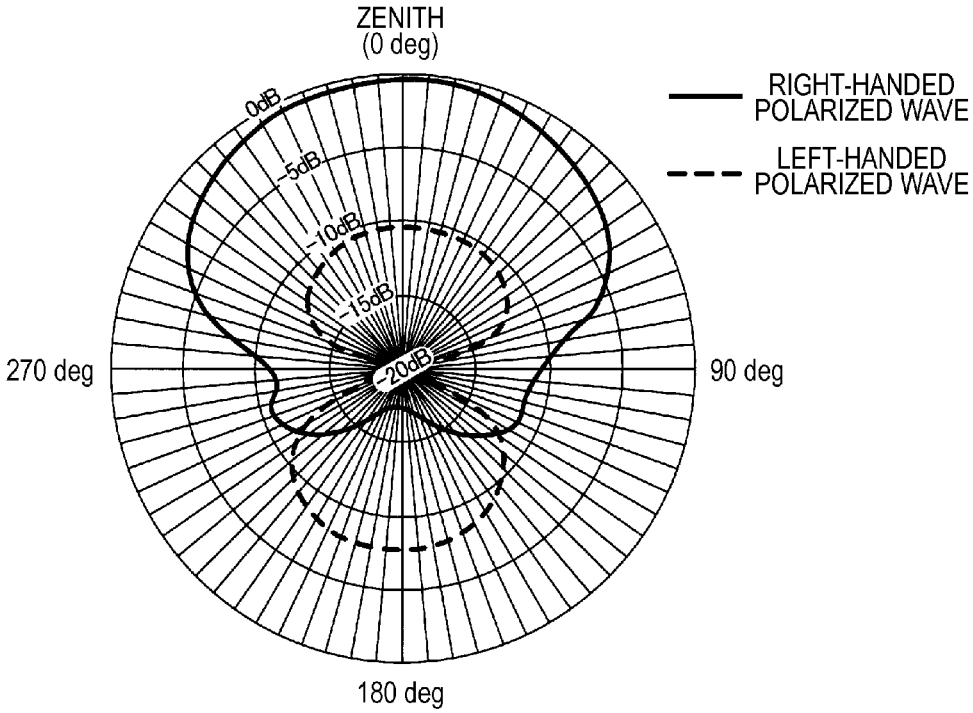
FIG. 5 shows the radiation pattern of the antenna 40 of the electronic timepiece 100.

FIG. 5 shows the radiation pattern of the antenna 40 when the signal frequency is approximately 1.5 GHz, the slot diameter is 3.5 cm, the slot width is 0.2 cm, and the dielectric constant of the dielectric 22 is 16. In addition, the radiation pattern shown in this figure is when the face is facing the zenith and the radiation pattern is on a plane parallel to the face-back cover direction (i.e., perpendicular to the face). The solid line denotes the radiation pattern of right-handed polarized waves, and the dotted line denotes the radiation pattern of left-handed polarized waves. Because the satellite signals are right-handed polarized waves, satellite signal reception performance increases as the gain of right-handed polarized waves increases, and increases as left-handed polarized wave gain decreases compared with right-handed polarized wave gain.

Because the depth direction of the slot 40*a* is the same as the direction between the face and back covers (face-back cover direction), the zenith is the direction of peak directivity when the face is facing the zenith. When thus positioned, the gain of right-handed polarized waves is −0.3 dB, and the gain of left-handed polarized waves is −10 dB in the direction of the zenith (0 deg) as shown in FIG. 5. In other words, the gain of right-handed polarized waves is sufficiently great, and the gain of left-handed polarized waves is sufficiently low compared with the right-handed polarized wave gain. This means that satellite signal reception performance is sufficiently high.

As described above, the electronic timepiece 100 has a case 80, crystal 84, drive mechanism 30, antenna 40, and dielectric 22. The antenna 40 has a side part 43, bottom part 42, and antenna electrode 41. The antenna electrode 41 extends circumferentially to the side part 43, and has a slot part 41*a* that contacts the dielectric 22. A slot 40*a* that extends circumferentially to the side part 43 is formed in the slot part 41*a*. The antenna electrode 41 therefore functions as an annular slot antenna. As a result, high reception performance of satellite signals from GPS satellites 20 can be maintained while using a metal external case 80.

Furthermore, because the dielectric 22 of the electronic timepiece 100 contacts the side part 43 from the face side and covers all of the slot 40*a*, the diameter of the antenna 40 can be shortened by the wavelength shortening effect. In addition, because the main plate 38 on which the drive mechanism 30 is disposed, the circuit board 25 on which the GPS reception unit 26 is mounted, and the storage battery 27 are housed inside the antenna 40, the size of the antenna 40 can be increased while also saving space.

Furthermore, while providing a slot antenna normally increases timepiece size accordingly, increase in the timepiece size is suppressed with this electronic timepiece 100 by disposing the slot antenna in available space (around the dial) inside the timepiece. The electronic timepiece 100 can therefore maintain sufficiently high reception performance of circularly polarized satellite signals while using a metal case and having a small size. Note that increasing antenna size contributes to improving reception performance.

A hole through which the center shaft 12 passes is also formed in the center part 41*b* of the antenna electrode 41 in this electronic timepiece 100. The same construction as a common analog timepiece having the center shaft 12 passing through the center of the dial 11 can therefore be used.

The electronic timepiece 100 also has a metal back cover 85, and the back cover 85 functions as the bottom part 42 of the antenna 40. The external case 80 is also a cylindrically shaped metal part that is made of metal, and this metal part also serves as the side part 43 of the antenna 40. The case 80 thus functions as the side part 43, and the back cover 85 functions as the bottom part 42 of the antenna 40. There is, therefore, no need to provide a side part separately from the case 80, and no need to provide a bottom part separately from the back cover 85. This also contributes to reducing timepiece size and weight.

The electronic timepiece 100 also has a solar panel 87 that extends transversely to the center axis of the side part 43, and converts light energy to electrical energy. The solar panel 87 is disposed between the antenna electrode 41 and the dial 11, and is housed on the inside of the slot part 41*a* when seen from the face-back cover direction. Because the solar panel 87 and the slot part 41*a* thus do not overlap in the face-back cover direction, reception performance can be maintained while enabling photovoltaic power generation.

The slot 40*a* in this electronic timepiece 100 is C-shaped (a circle with an opening in one place), and the antenna 40 has power supply nodes A and B. The power supply nodes A and B are disposed within a range of 10°<=90° from the closer of the two ends of the slot 40*a*. As a result, good reception performance can be achieved in the electronic timepiece 100 as shown in FIG. 5.

A configuration rendering a slot in the external case is also conceivable. However, because this requires using a technique such as skiving, it is not suited to mass production because dimensional variation is great and achieving consistent antenna performance is difficult. This also reduces the design freedom because a slot must be formed in the outside case. The electronic timepiece 100 according to this embodiment of the invention, however, is well suited to mass production and offers a high degree of design freedom because the slot is inside the external case.

Note that the antenna electrode 41 and solar panel 87 are separate parts in this embodiment of the invention, but they could be rendered in unison. For example, a solar panel with a stainless steel substrate could be used, and the slot 40*a* could be rendered in the substrate. In this case the substrate of the solar panel can be used as part of the antenna electrode. Note that if the solar panel substrate is used as part of the antenna electrode, other parts of the antenna electrode can be printed using silver paste.

Embodiment 2

Figure 6:
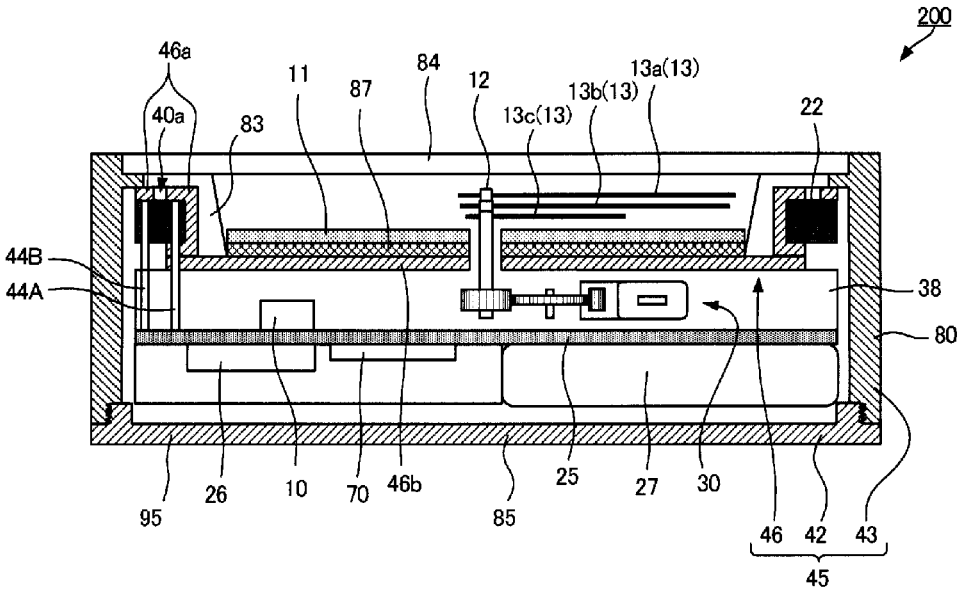
FIG. 6 is a partial section view of an electronic timepiece with internal antenna 200 (electronic timepiece 200) according to a second embodiment of the invention.
Figure 7:
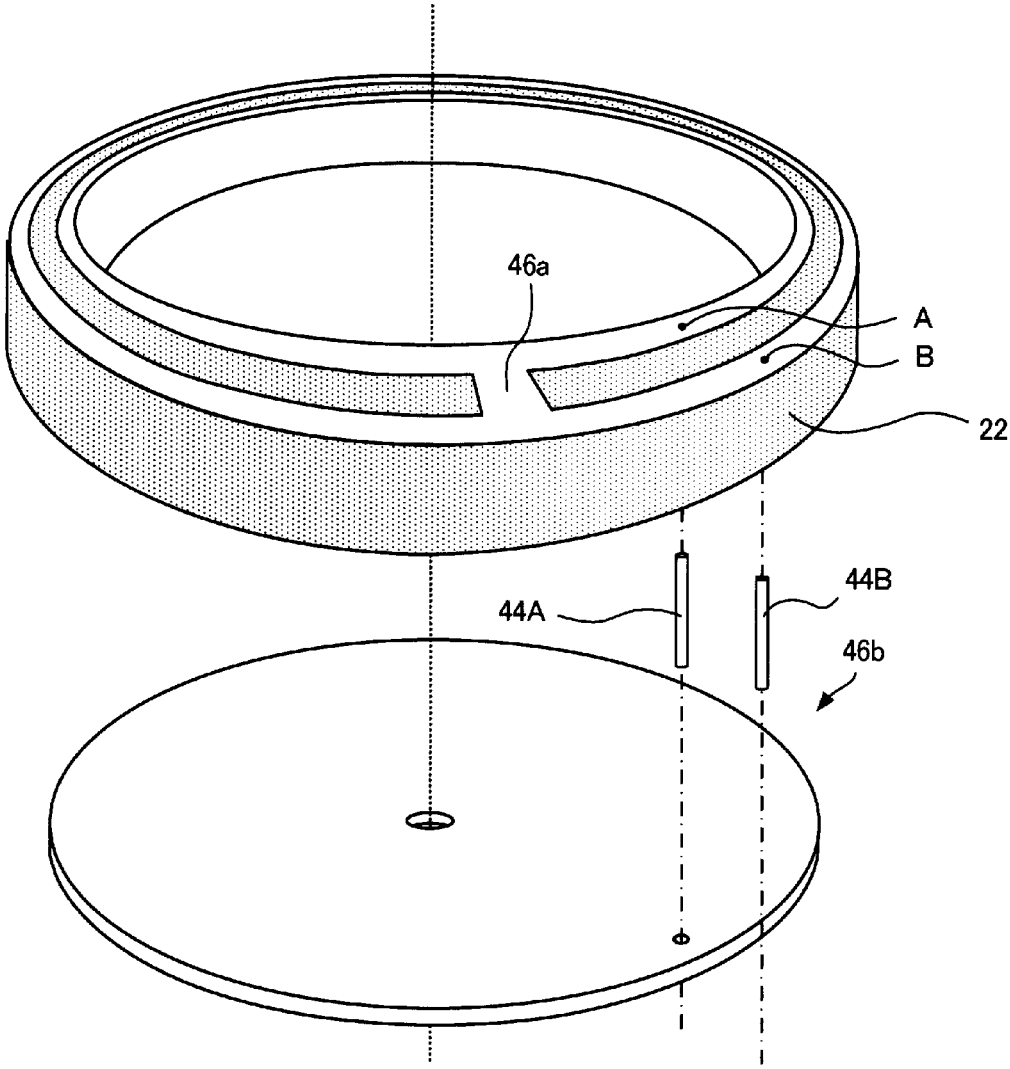
FIG. 7 is an exploded perspective view of part of the electronic timepiece 200.

FIG. 6 is a partial section view of an electronic timepiece with internal antenna 200 (electronic timepiece 200) according to a second embodiment of the invention, and FIG. 7 is an exploded perspective view of part of the electronic timepiece 200. The antenna 45 used in this electronic timepiece 200 differs from the antenna 40 in the foregoing electronic timepiece 100. This antenna 45 is made of metal similarly to antenna 40, but differs from antenna 40 by using antenna electrode 46 instead of antenna electrode 41.

This antenna electrode 46 has an annular slot part 46*a* instead of slot part 41*a*, and a round center part 46*b* instead of center part 41*b*. The slot part 46*a* and center part 46*b* are discrete parts. The slot part 46*a* is an electrode pattern formed by electroless plating of a metal such as copper, nickel, or gold on part of the dielectric 22. The center part 41*b* is a stainless steel plate, and has a hole formed in the center through which the center shaft 12 passes.

The inside part of the slot 40*a* in the slot part 46*a* contacts the center part 46*b*, and the outside part of the slot 40*a* contacts the case 80. In other words, the center part 46*b* and the case 80 are electrically connected through the slot part 46*a*.

Conductive pin 44A passes through the main plate 38, center part 46*b*, the slot part 46*a* on the back side of the dielectric 22, and the dielectric 22, and contacts power supply node A and the circuit board 25. As a result, a hole through which the conductive pin 44A passes is formed in the center part 46*b* and the slot part 46*a* on the back side of the dielectric 22.

The conductive pin 44B, however, passes through the main plate 38 and contacts power supply node B and the circuit board 25 without passing through the center part 46*b*, the slot part 46*a* on the back side of the dielectric 22, and the dielectric 22.

As will be known from the foregoing description, the electronic timepiece 200 has the same effect as the electronic timepiece 100. In addition, because the antenna electrode consists of two parts, an electrode pattern and a separate plate, this plate can also be used as the substrate of the solar panel. In other words, the solar panel substrate can be used as part of the antenna electrode. This contributes to reducing the thickness and the size of the timepiece.

Embodiment 3

Figure 8:
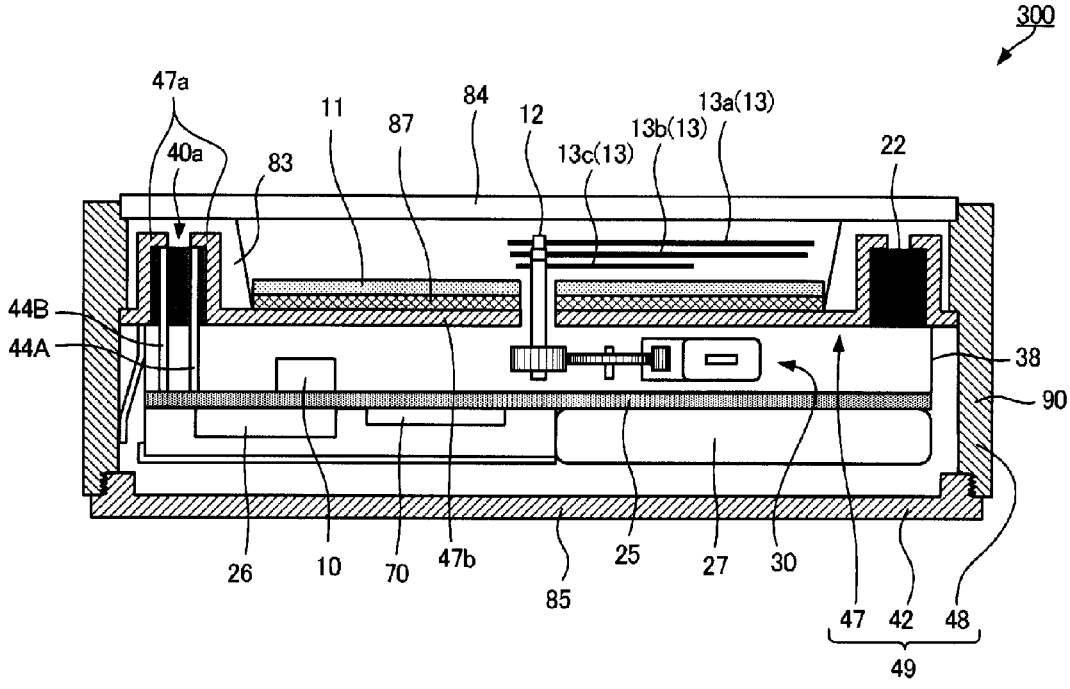
FIG. 8 is a partial section view of an electronic timepiece with internal antenna 300 (electronic timepiece 300) according to a third embodiment of the invention.
Figure 9:
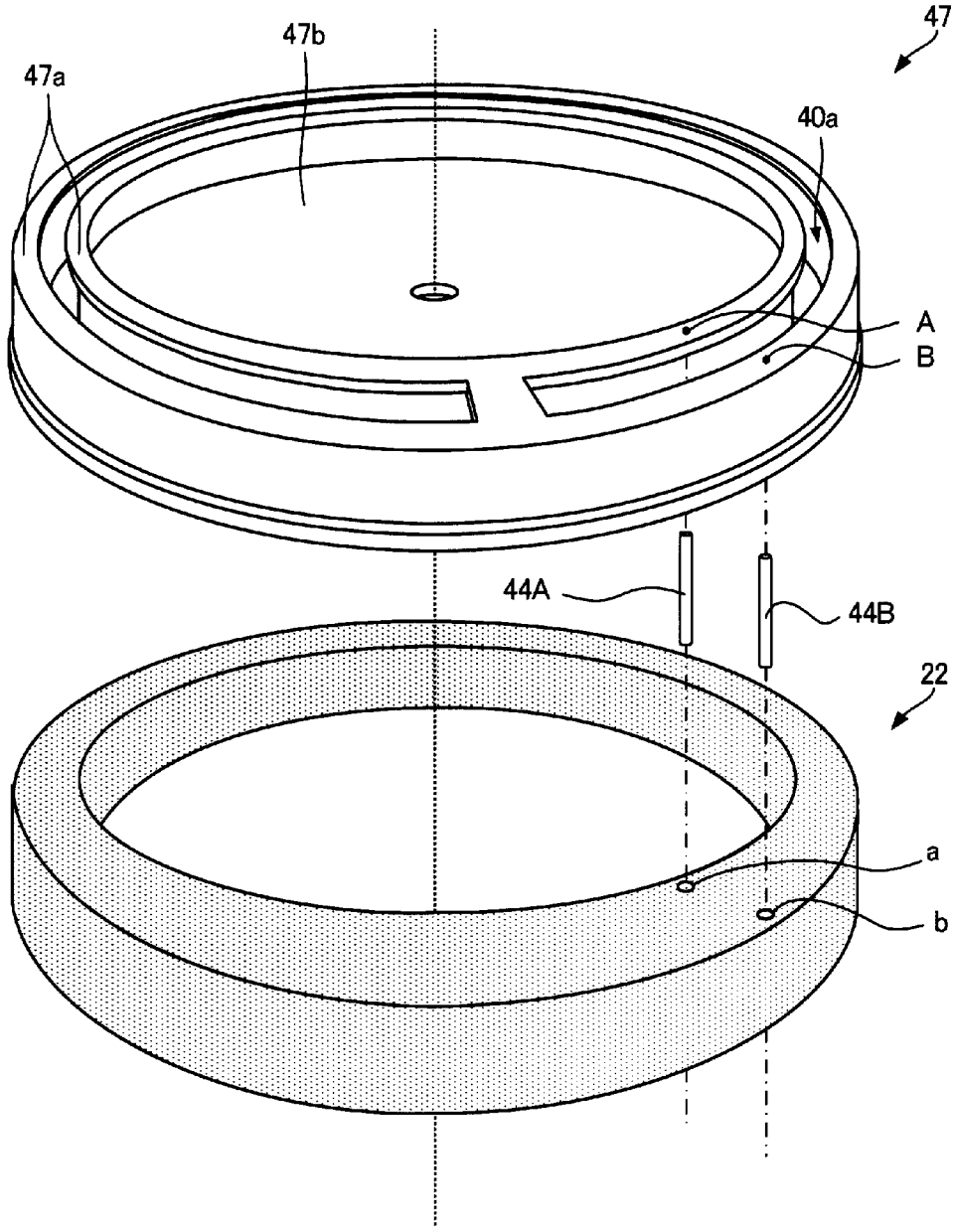
FIG. 9 is an exploded perspective view of part of the electronic timepiece 300.

FIG. 8 is a partial section view of an electronic timepiece with internal antenna 300 (electronic timepiece 300) according to a third embodiment of the invention, and FIG. 9 is an exploded perspective view of part of the electronic timepiece 300. This electronic timepiece differs from the electronic timepiece 100 described above by using antenna 49 and external case (metal part) 90 instead of antenna 40 and case 80.

This antenna 49 differs from antenna 40 by having antenna electrode 47 and side part 48 instead of antenna electrode 41 and side part 43. While the case 80 functions as the side part 43 in electronic timepiece 100 above, case 90 functions as the side part 48 in this embodiment. This case 90 differs from case 80 only by the inside shape. The antenna electrode 47 has a slot part 47*a* corresponding to slot part 41*a*, and a center part 47*b* corresponding to center part 41*b*. The slot part 47*a* has a C-shaped slot 40*a* identical to slot part 41*a*, but differs from slot part 41*a* in that it covers the outside circumference of the slot 40*a*. More specifically, the antenna electrode 47 according to this embodiment of the invention contacts the external case at the bottom part of the antenna to render the antenna 49, and thus differs from the antenna electrodes of the other embodiments.

As will be known from the foregoing description, the electronic timepiece 300 has the same effect as the electronic timepiece 100. Note that because the antenna electrode is covered to the outside of the dielectric in this embodiment, a construction in which the antenna electrode contacts the case at the top part of the antenna could also be used. More specifically, various configurations could be used for contact between the antenna electrode and the case. This embodiment therefore enables using variously constructed external cases, and can improve the freedom of timepiece design.

Embodiment 4

Figure 10:
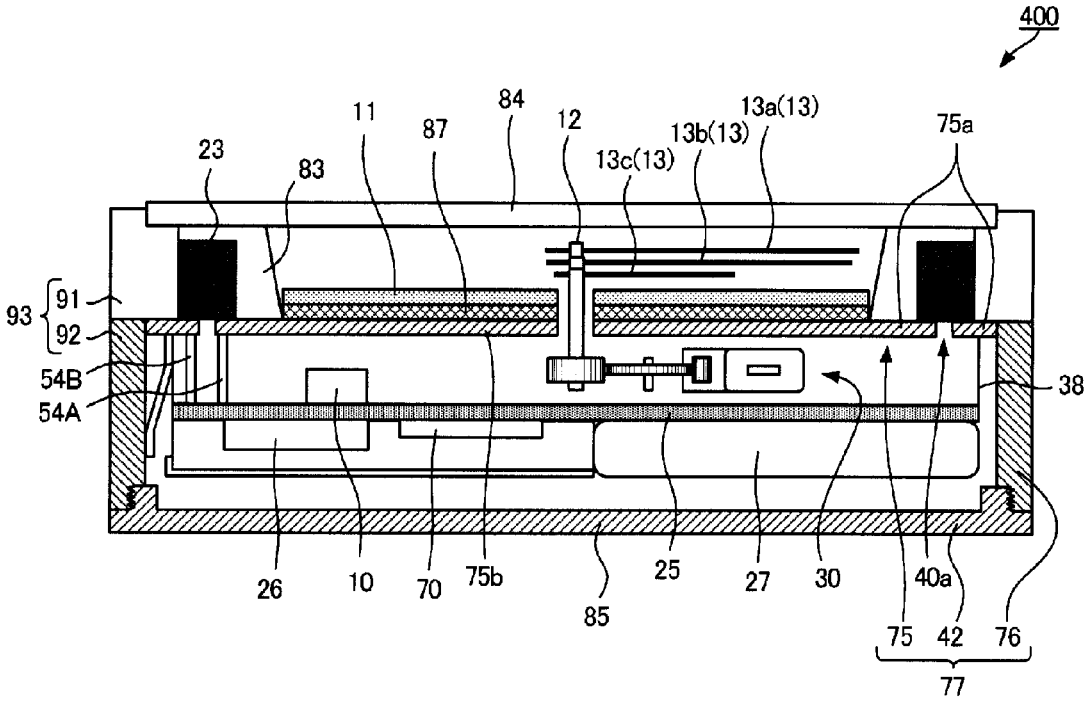
FIG. 10 is a partial section view of an electronic timepiece with internal antenna 400 (electronic timepiece 400) according to a fourth embodiment of the invention.
Figure 11:
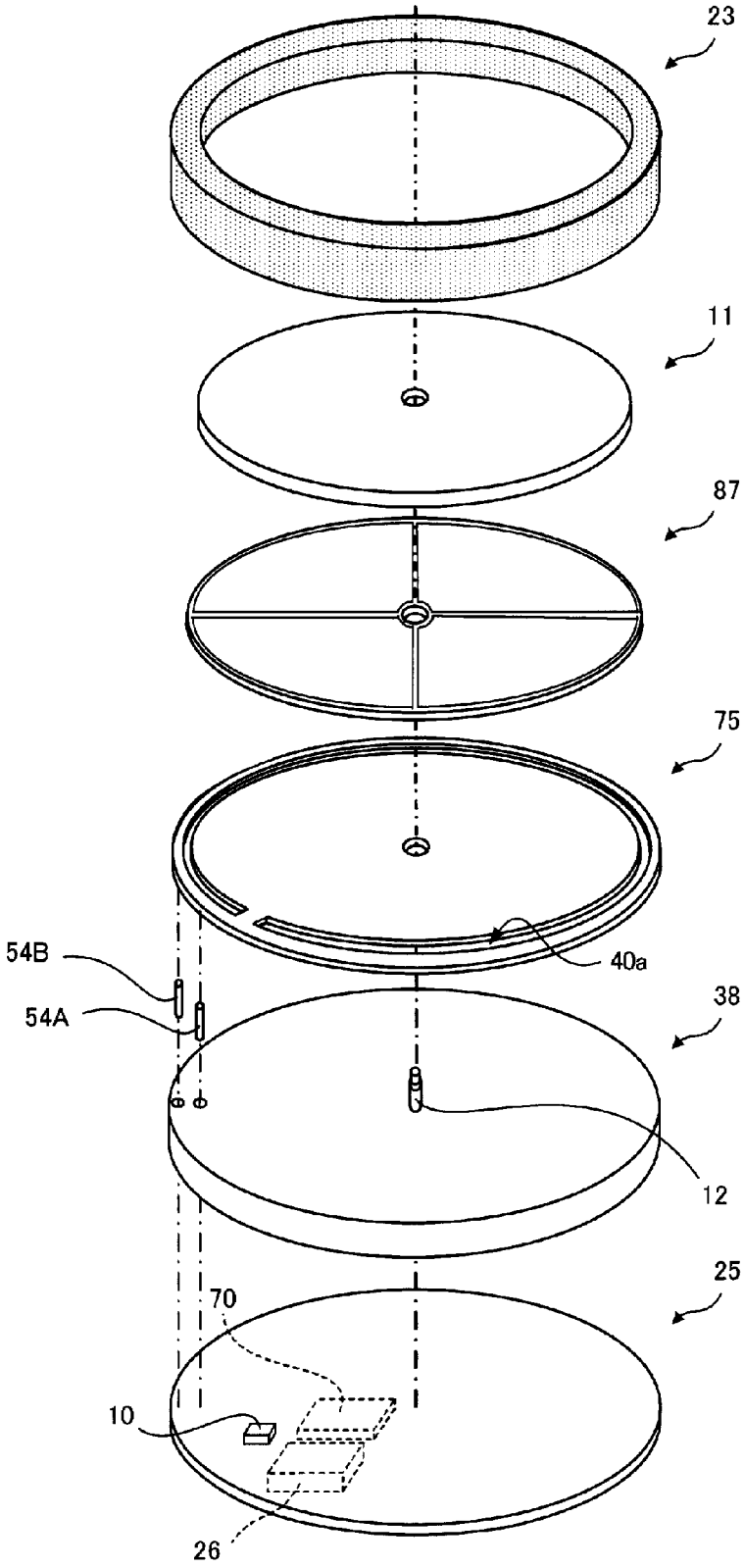
FIG. 11 is an exploded perspective view of part of the electronic timepiece 400.

FIG. 10 is a partial section view of an electronic timepiece with internal antenna 400 (electronic timepiece 400) according to a fourth embodiment of the invention, and FIG. 11 is an exploded perspective view of part of the electronic timepiece 400. This electronic timepiece 400 differs from the electronic timepiece 300 described above by disposing the dielectric on the face side of the slot. As a result, this electronic timepiece 400 has an external case 93, antenna 77, dielectric 23, and conductive pins 54A and 54B as shown in FIG. 10 instead of the case 90, antenna 49, dielectric 22, and conductive pins 44A and 44B of the electronic timepiece 300 shown in FIG. 8.

The case 93 has a cylindrical bezel 91 located on the face side, and a cylindrical body 92 located on the back side of the bezel 91. The body 92 is a metal part made of stainless steel, titanium, or other metal. Of the two openings in the body 92, the opening on the back side is covered by a back cover 85. The bezel 91 is made from a non-conductive member of ceramic or plastic, for example, and a dial ring 83 is on the inside circumference side thereof. Of the two openings in the bezel 91, the opening on the face side is covered by a crystal 84.

The antenna 77 is a hollow cylinder, and has an antenna electrode 75 and a side part 76 instead of the antenna electrode 47 and side part 48 described above. This antenna electrode 75 differs from the foregoing antenna electrode 47 only in that it is a plate that extends transversely to the center axis of the side part 76 on the inside of the body 92, and contacts the inside circumference of the side part 76. The antenna electrode 75 covers the face-side opening of the two openings in the body 92.

Similarly to the slot part 47*a* and the center part 47*b* of the antenna electrode 47, antenna electrode 75 has a slot part 75*a* and a center part 75*b*. A C-shaped slot 40*a* is formed in the slot part 75*a* similarly to slot part 47*a*. However, while slot part 47*a* is a bent plate, slot part 75*a* is flat. This is because a dielectric 23 in which through-holes for passing conductive pins are not formed is used instead of dielectric 22, and short conductive pins 54A and 54B are used instead of long conductive pins 44A and 44B.

Furthermore, while case 90 functions as side part 48, body 92 functions as side part 76. More specifically, the bezel 91 does not function as side part 76. The dielectric 22 is disposed along the inside circumference of the bezel 91, contacts the slot part 75*a* in the face-back cover direction, and covers all of the slot 40*a*. The dielectric 23 is also covered by the dial ring 83 when seen from the face side.

As will be known from FIG. 11, the slot 40*a* can be formed in the antenna electrode 75 by press processing a stainless steel disc, for example. Note that in this embodiment the antenna electrode 75 and the solar panel 87 are separate, but they could be rendered in unison. For example, a solar panel with a stainless steel substrate could be used, and the slot 40*a* could be formed in the substrate. In this case, the substrate of the solar panel could be used as part or all of the antenna electrode. Note that when the solar panel substrate is used as part of the antenna electrode, the other parts of the antenna electrode could be formed by printing silver paste, for example.

As will be known from the foregoing description, this electronic timepiece 400 has the same effect as the foregoing electronic timepiece 300. In addition, the antenna electrode 75 is flat and through-holes need not be formed in the dielectric in this electronic timepiece 400. More specifically, the antenna structure is simple, and therefore has the advantage of being easily manufactured at a low cost. In addition, if a slot is disposed in the solar panel substrate, and the solar panel and antenna electrode are rendered in unison, the solar panel substrate can be used as part of the antenna electrode when based on the configuration shown in FIG. 8, but the solar panel substrate can be used as all of the antenna electrode when based on the configuration shown in FIG. 10.

Embodiment 5

Figure 12:
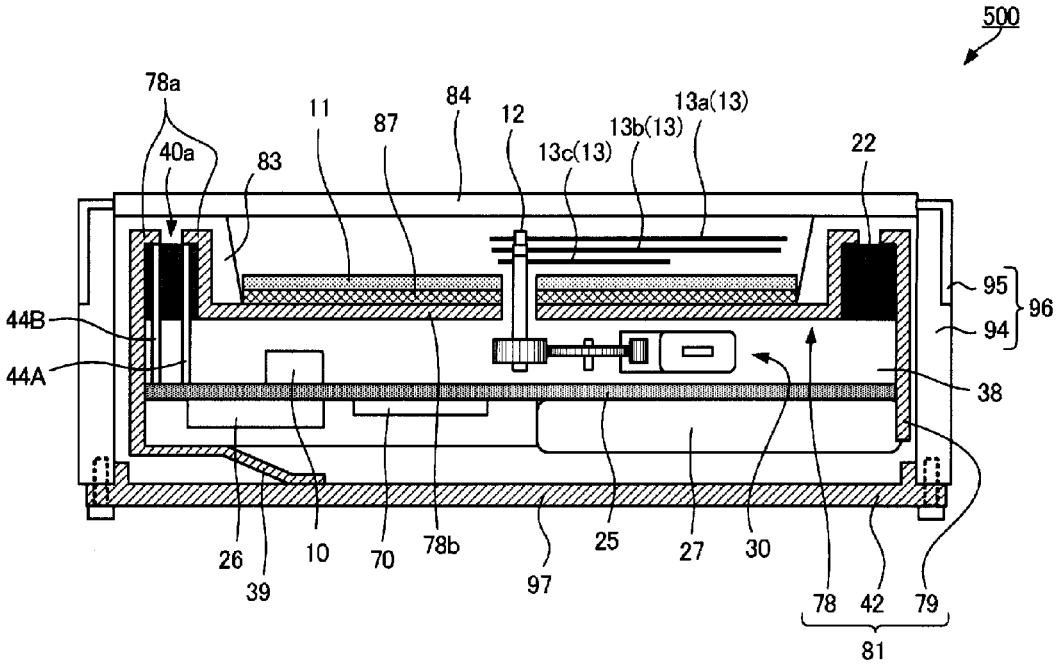
FIG. 12 is a partial section view of an electronic timepiece with internal antenna 500 (electronic timepiece 500) according to a fifth embodiment of the invention.

FIG. 12 is a partial section view of an electronic timepiece with internal antenna 500 (electronic timepiece 500) according to a fifth embodiment of the invention. This electronic timepiece 500 differs from the electronic timepiece 300 described above by having external case 96 and antenna 81 instead of case 90 and antenna 49.

The case 96 includes a cylindrical body 94 made of plastic, and a metal cover (metal part) 95 that partially covers the body 94. Of the two openings in the body 94, the opening on the face side is covered by the crystal 84, and the opening on the back side is covered by aback cover 97. The back cover 97 is made of metal and is screw-fastened to the body 94. The cover 95 is for imparting a high-quality feel to the timepiece, and covers the exposed surface of the face side of the body 94.

The antenna 81 is made of metal, and has an antenna electrode 78 and side part 79 instead of antenna electrode 47 and side part 48. The antenna electrode 78 has a slot part 78*a* and a center part 78*b* similarly to the slot part 47*a* and center part 47*b* of the antenna electrode 47, but while case 90 also functions as the side part 48, the case 96 does not function as side part 79. The side part and external case are thus separate parts in this electronic timepiece 500.

The antenna electrode 78 and side part 79 are rendered in unison, and the cylindrical part that extends to the back cover side from the outside edge of the antenna electrode 78 is the side part 79 of this integrated member. The side part 79 contacts the metal back cover 97 through a contact spring 39. The antenna 81 therefore functions as a round slot antenna without including the case 96. Note that in order to reduce the parts of the slot that do not contribute to antenna performance, the side part 79 and back cover 97 are preferably placed together, for example, to reduce the parts where the gap therebetween is too large.

As will be known from the foregoing description, this electronic timepiece 500 has the same effect as the foregoing electronic timepiece 300. In addition, because the side part 79 can be rendered separately from the case 96, the metal portion of the external case can be reduced in this electronic timepiece 500. This contributes to reducing the production cost and improving design freedom.

Variations

The embodiments and variations thereof described above can be modified as shown in the following examples. Note that the foregoing embodiments and variations thereof, the modifications described below, and configurations rendered by suitably combining the following exemplary modifications and the foregoing embodiments and variations thereof, are also included in the scope of the invention.

For example, configurations that receive circularly polarized waves other than right-handed polarized waves, such as left-handed polarized waves, are also conceivable. Configurations that receive signals of different frequencies than satellite signals from GPS satellites are also conceivable. Charging methods other than solar charging methods may also be used, and primary cells such as lithium batteries may be used instead of a storage battery 27. Note that when a charging method other than solar charging is used, the slot may be formed in a metal dial, and the dial may be used as part or all of the antenna electrode.

The shape of the slit may be any shape enabling receiving circularly polarized waves, and may be other than C-shaped.

Figure 13:
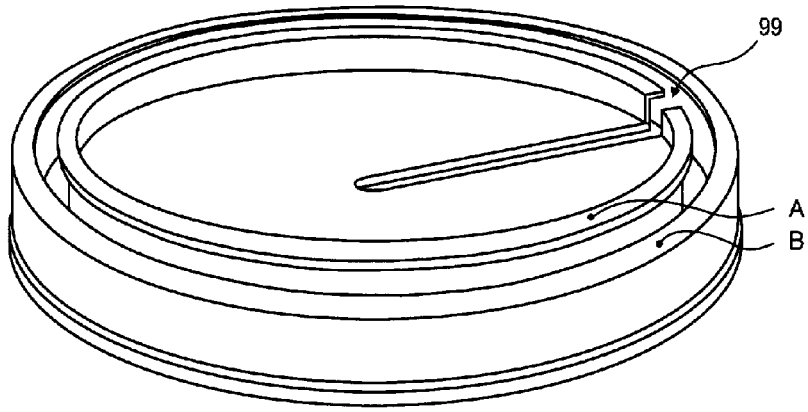
FIG. 13 is a perspective view showing an example of a slot form that is not C-shaped.

FIG. 13 is a perspective view showing an example of a slot that is not C-shaped. The slot shown in this figure has an O-shaped part and a part that splits at a break 99 and continues toward the center. Note that when an antenna electrode as shown in FIG. 13 is used, the dielectric will cover part of the slot (the O-shaped part) in the face-back cover direction. It will thus be obvious that the dielectric may cover part and not all of the slot. A C-shaped (open circle) dielectric may also be used instead of an O-shaped (closed circle) dielectric.

An image display unit that displays images may also be disposed to the main plate 38, and a window for viewing the images may be formed in the middle of the slot antenna. An example of such a timepiece is a hybrid timepiece that has a liquid crystal display device as the image display unit, and has both an analog display and a digital display.

Further alternatively, a cylindrical side part may be provided separately to the external case. More specifically, a metal side part may be disposed inside the case 80 or inside the body 92 in contact with the antenna electrode and bottom part. This configuration enables using a rectangular case member instead of a round case. The back cover will, of course, also be a polygon.

Further alternatively, a round bottom part may be provided separately from the back cover. More specifically, a bottom part is disposed on the face side of the back cover 85 and the back cover side of the antenna electrode so that the bottom part contacts the side part. A cylindrical side part may also be provided separately from the external case, and a round bottom part disposed separately from the back cover. In this case, an external case that is entirely non-conductive can be used instead of an external case that is all or part metal, and a non-conductive back cover can be used instead of a metal back cover. This contributes to suppressing the product cost.

Note that to improve reception performance, the slot is preferably disposed on the face side, and no other member intervenes between the crystal 84 and the slot. In this case, the dielectric can be hidden without providing a dial ring by printing a pattern in a ring on the back side of the crystal 84.

Because the external case is made with a metal side part in the foregoing embodiments and variations, the antenna characteristics of the antenna can be affected by touching the case. More specifically, because the area near the antenna slot has a high current density and is sensitive to external factors, touching the case near the antenna slot by hand can very like result in the antenna characteristics becoming unstable. Part of the case could therefore consist of a ceramic bezel.

Figure 14:
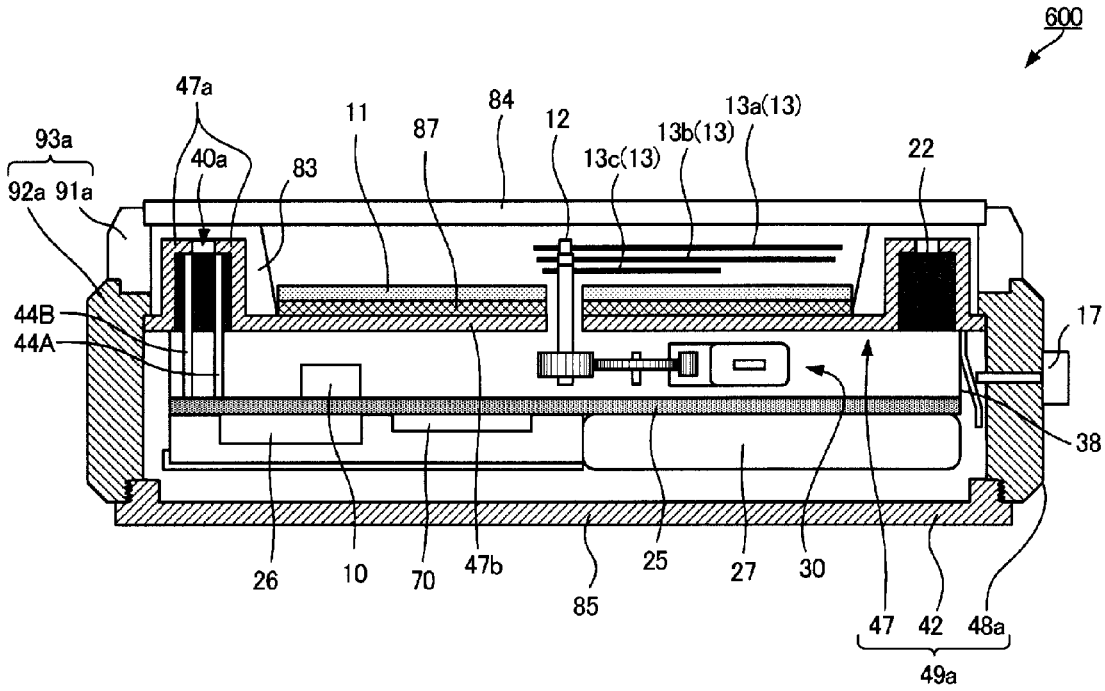
FIG. 14 is a partial section view of another electronic timepiece 600.

FIG. 14 is a partial section view of an electronic timepiece with internal antenna 600 (electronic timepiece 600) according to another embodiment of the invention. This electronic timepiece 600 is identical to the electronic timepiece 300 shown in FIG. 8 except for having antenna 49*a* and case 93*a* instead of antenna 49 and case 90.

The antenna 49*a* is identical to antenna 49 except for having side part 48*a* instead of side part 48.

The case 93*a* has a cylindrical bezel 91*a* on the face side, and a cylindrical body 92*a* on the back-cover side of the bezel 91*a*.

The body 92*a* is made of metal and functions as side part 48*a*.

The bezel 91*a* is made from a zirconia ceramic that does not affect radio waves in the 1.5 GHz band. The antenna characteristics of the electronic timepiece 600 can be stabilized because the part of the antenna 49*a* near the slot 40*a* is covered on the side by the bezel 91*a* made of a non-conductive material, and the face side is covered by the crystal 84.

The electronic timepiece 600 can also use a structure in which the antenna electrode contacts the case at the top part of the antenna because the antenna electrode is covered to the outside of the dielectric. More specifically, various constructions can be used to establish contact between the antenna electrode and the external case. This embodiment therefore enables using variously constructed external cases, and can improve the freedom of timepiece design.

Further alternatively, a configuration in which power supply node A and LNA 51 are electrically connected through the balun 10, and power supply node B and the case to which ground potential is supplied are electrically connected through the balun 10, is also conceivable.

Figure 15:
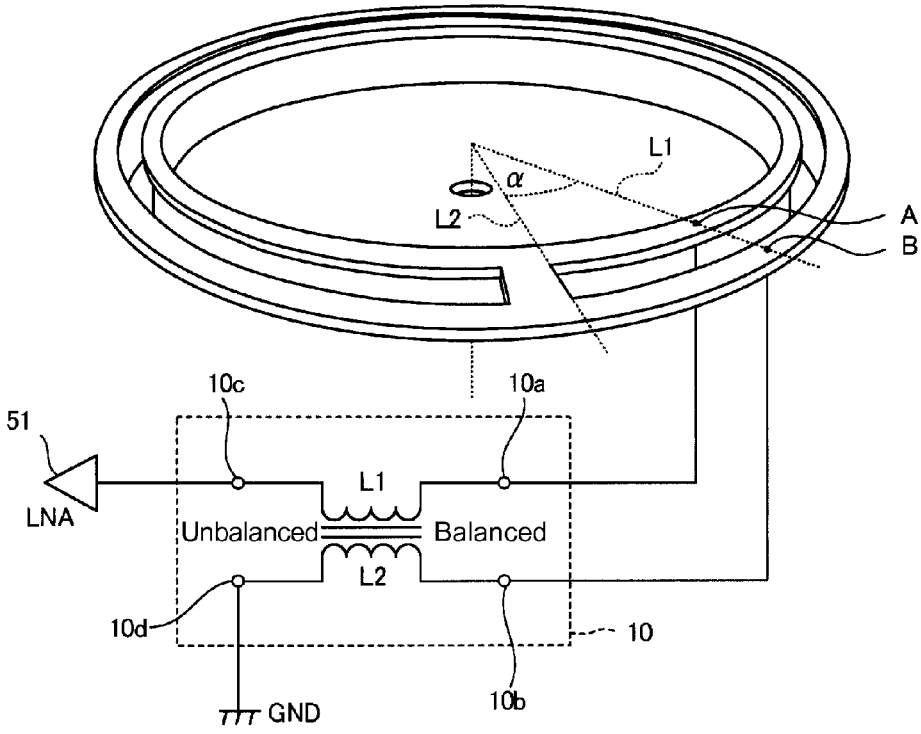
FIG. 15 is a circuit diagram of a balun 10.

FIG. 15 is a circuit diagram of a balun 10. As shown in FIG. 15, the balun 10 has coils L1 and L2. Node 10*a* on the balanced side of coil L1 is electrically connected to power supply node A, and node 10*c* on the unbalanced side is electrically connected to LNA 51. In addition, node 10*b* on the balanced side of coil L2 is electrically connected to power supply node B, and node 10*d* on the unbalanced side is electrically connected to the external case to which the ground potential is supplied.

As shown in FIG. 15, power supply node A is disposed to a part of the antenna electrode on the dial side of the slot. As a result, power supply node A is not directly connected to the outside case. The face side of power supply node A is also covered by the crystal 84. Static electricity can therefore be prevented from penetrating to the power supply node A from the outside of the electronic timepiece.

If static passes through the power supply node to the LNA 51 and a voltage exceeding the voltage resistance of the input transistor of the LNA 51 is applied, the LNA 51 can be damaged by the static electricity. However, when the electronic timepiece is constructed to prevent static electricity from passing from the outside to the power supply node A connected to the LNA 51 as shown in FIG. 15, the possibility of the LNA 51 being damaged by static electricity can be reduced.

Figure 16:
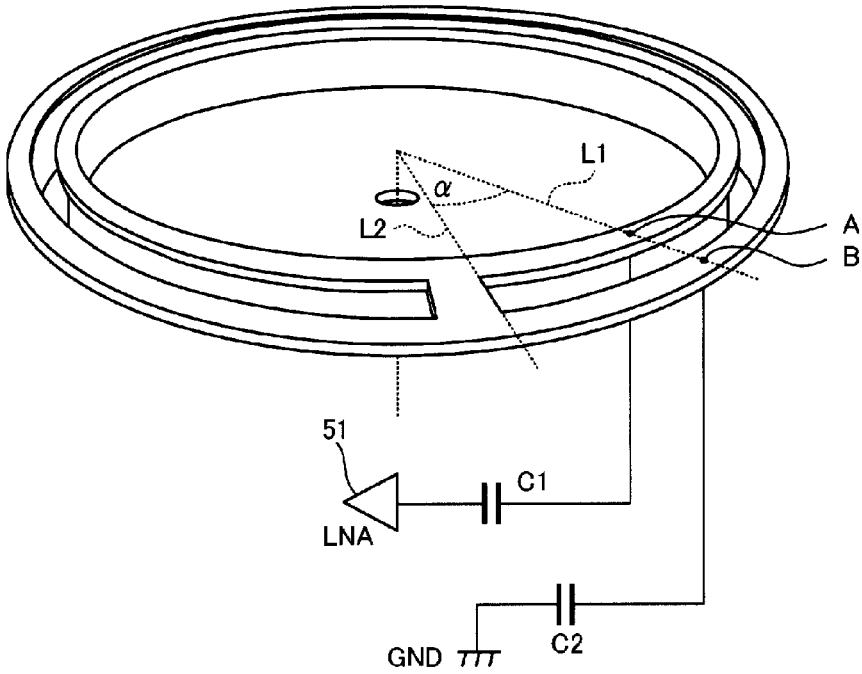
FIG. 16 describes connections between power supply nodes A and B, LNA 51, and the external case.

Further alternatively, as shown in FIG. 16, a configuration in which power supply node A and the LNA 51 are electrically connected through a coupling capacitor C1, and power supply node B and the case to which ground potential is supplied are electrically connected through a coupling capacitor C2, is also conceivable. In this case, the antenna outputs received signals as unbalanced signals, and the electronic timepiece with internal antenna can be constructed without using a balun 10. Furthermore, because the power supply node B, which is closer to the external case than power supply node A, and the case member are electrically connected in this configuration, the connection between the power supply node and the case member can be simplified.

Note that if outputting an unbalanced signal is the objective, a configuration in which power supply node B and LNA 51 are electrically connected, and power supply node A and the external case member are electrically connected, is also conceivable.

Figure 17:
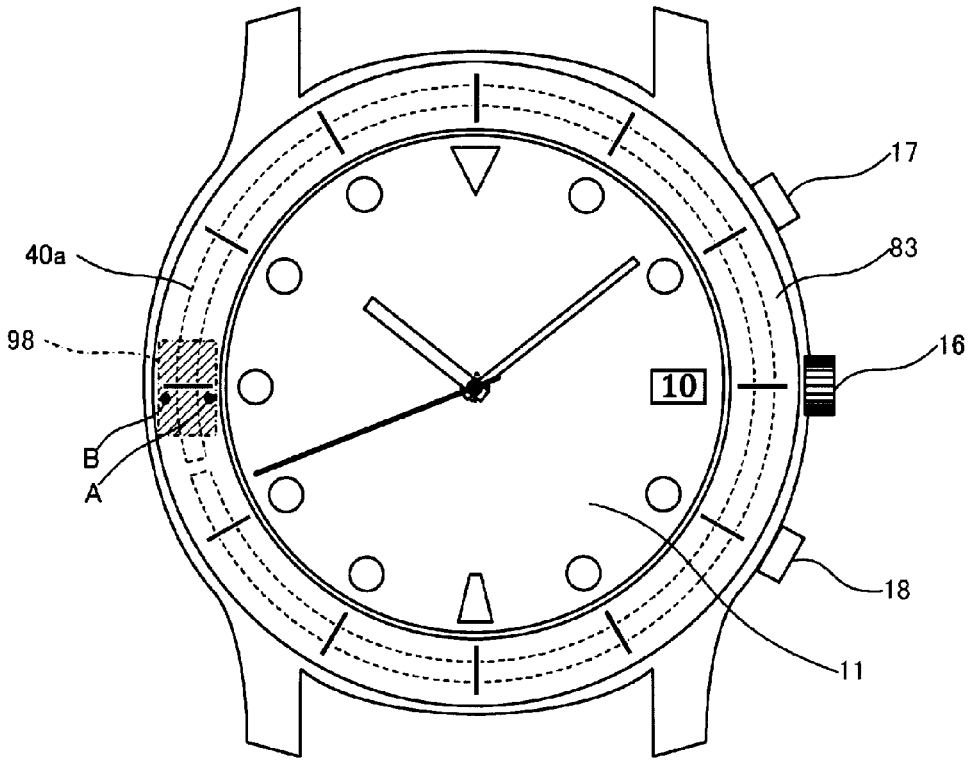
FIG. 17 is a plan view of an electronic timepiece.

Further alternatively, as shown in FIG. 17, the slot 40*a* could be disposed to a position on the back cover side of the dial ring 83 covered by the dial ring 83 when the electronic timepiece is seen from the face side. If the dial 11 is disposed between the slot 40*a* and the crystal 84, antenna reception performance deteriorates. However, if the slot 40*a* is disposed to a position covered by the dial ring 83 when seen from the face (that is, at the outside circumference part of the dial 11), the dial 11 will not be between the slot 40*a* and the crystal 84, and the antenna can be rendered with good reception performance.

Further alternatively, the power supply node and crown (and buttons) could be disposed on opposite sides of the dial 11 when the electronic timepiece is seen from the face side. As shown in FIG. 17, when button 17, the crown 16, and button 18 are respectively disposed to positions at 2:00, 3:00, and 4:00, power supply nodes A and B can be disposed to an area 98 around 9:00. In this case, because the power supply nodes and the circuit board are on opposite sides of the dial 11, the connections between the power supply nodes A and B and the circuit board can be designed more freely.

The dielectric is located on the face side of the drive mechanism 30 in the embodiments and variations described above, but the invention is not so limited and the thickness of the dielectric may be increased.

Figure 18:
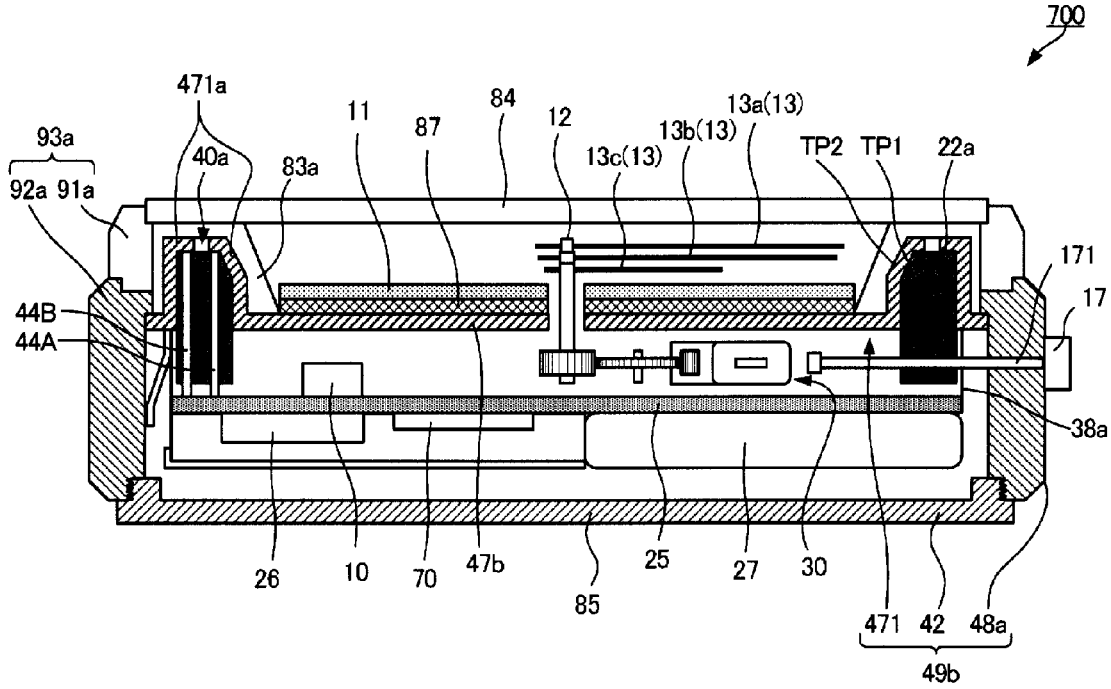
FIG. 18 is a partial section view of another electronic timepiece 700.

FIG. 18 is a partial section view of an electronic timepiece with internal antenna 700 (electronic timepiece 700) according to another embodiment of the invention. This electronic timepiece 700 is identical to the electronic timepiece 600 shown in FIG. 14 except for using dielectric 22*a*, main plate 38*a*, antenna 49*b*, and dial ring 83*a* instead of dielectric 22, main plate 38, antenna 49*a*, and dial ring 83.

The thickness of the dielectric 22*a* is greater than the thickness of dielectric 22. As a result, the length of the section of the dielectric 22*a* perpendicular to the center shaft 12, that is, the width of the dielectric 22*a* in section, can be made thinner than the width of the dielectric 22 in section to achieve the same reception performance, and the size of the electronic timepiece 700 can be reduced. Note that when the bottom of the dielectric 22*a* (the surface on the back cover side) is positioned closer to the back cover than the stem 171 of button 17, a through-hole c for passing the stem 171 is formed in the dielectric 22*a* as shown in FIG. 19.

Figure 19:
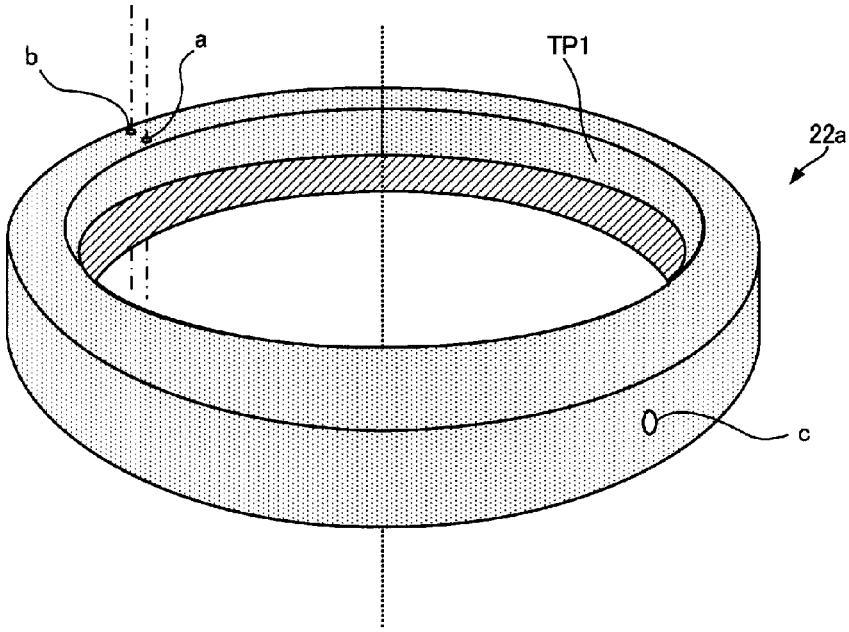
FIG. 19 is an oblique view of dielectric 22*a*.

As shown in FIG. 18 and FIG. 19, the dielectric 22*a* has a taper TP1. The slot part 471*a* also has a taper TP2, and the dial ring 83*a* is disposed covering the slot part 471*a*. By providing a taper TP1 and taper TP2 on the dielectric 22*a* and slot part 471*a*, the user can see all of the dial 11 even when looking at the dial 11 from an angle to the face, and dial 11 visibility can be improved.

Furthermore, by proving tapers TP1 and TP2, the width of the dial ring 83*a* covering the dielectric 22*a* and slot part 471*a* can be reduced, and the design of the electronic timepiece 700 can be improved. In addition, by providing tapers TP1 and TP2, the shadow of the bezel 91 on the dial can be reduced, and the actual power generating of the solar panel 87 can be improved.

Note that because the dielectric 22*a* is sufficiently thick as described above, the volume of the dielectric 22*a* can be increased compared with dielectric 22 even if the dielectric 22*a* has a taper TP1.

Yet further, a wrist-worn electronic device according to the invention is not limited to configurations that receive satellite signals from positioning information satellites as described above, and the invention can also be applied to near-field wireless receiving devices (RFID functions in the 900 MHz band) in circularly polarized wave RFID tags that operate in the 900 MHz band. A wrist-worn electronic device according to the invention is further not limited to configurations that receive circularly polarized waves, and can also be used to receive linear polarized waves.

The invention can also be used with other types of radio waves, including Bluetooth (R) devices for wireless communication in the 2.4 GHz band, and wireless LAN devices.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application Nos. 2010-253429, filed Nov. 12, 2010 and 2011-144253, filed Jun. 29, 2011 are expressly incorporated by reference herein.

What is claimed is:

1. An electronic timepiece with internal antenna, comprising:

an external case;

a drive unit within the external case that keeps time;

an antenna that has a tube-shaped side part, a bottom part that covers one of two openings on the side part, and a top part that is in contact with an inside circumference of the side part within the external case;

wherein the bottom part is a back cover of the external case, and the top part has a slot section in which is formed a slot extending circumferentially along at least a portion of the inside circumference of the side part, the slot section being a conductive part of the antenna.

2. The electronic timepiece with internal antenna as described in claim 1, wherein the slot extends along the entire inside circumference of the side part.

3. The electronic timepiece with internal antenna as described in claim 1, wherein a dielectric material in contact with the top part is provided within the side part.

4. The electronic timepiece with internal antenna as described in claim 1, wherein the dielectric material overlaps a portion or all of the slot.

5. The electronic timepiece with internal antenna as described in claim 1, wherein the drive unit is placed between the bottom part and the top part.

6. The electronic timepiece with internal antenna as described in claim 1, wherein the external case has a metal section formed by a metal.

7. The electronic timepiece with internal antenna as described in claim 6, wherein the metal section doubles as part or all of the side part.

8. The electronic timepiece with internal antenna as described in claim 1, further comprising:

a cover glass;

hands; and a dial plate positioned between the hands and the top part;

wherein the drive unit is provided with a mechanism to drive the hands; and wherein the slot is positioned between the dial plate and the side part when viewed from a direction perpendicular to the cover glass.

9. The electronic timepiece with internal antenna as described in claim 1, wherein:

the hands rotate around a hand axis;

the top part has a center section surrounded by the slot section; and the center section has a hole through which the hand axis passes.

10. The electronic timepiece with internal antenna as described in claim 1, further comprising:

an image display part that is placed between the top part and the bottom part and which displays an image;

wherein the top part has a center section surrounded by the slot section; and the center section has a hole for visually verifying the image.

11. An electronic timepiece with internal antenna comprising:

an external case;

a drive unit within the external case that keeps time;

an antenna that has a tube-shaped side part, a bottom part that covers one of two openings on the side part, and a top part that is in contact with an inside circumference of the side part within the external case;

a cover glass; and a photoelectric conversion panel that converts light energy into electrical energy;

wherein the bottom part is a back cover of the external case, and the top part has a slot section; and wherein the photoelectric conversion panel is placed between the cover glass and the top part and is housed inside the slot section.

12. The electronic timepiece with internal antenna as described in claim 1, wherein:

the slot is C-shaped; and the antenna has a feeding point at a prescribed position with respect to a tip of the slot.

* * * * *